US006167679B1

(12) United States Patent
Horton-Steidle et al.

(10) Patent No.: US 6,167,679 B1
(45) Date of Patent: Jan. 2, 2001

(54) COMBINATION CUSTOM PRINTED FORM AND CONTAINER AND METHOD OF USING

(75) Inventors: Katherine C. Horton-Steidle, Collingswood, NJ (US); Timothy W. Rawlings, Waynesville; Brett A. Shelton, Beavercreek, both of OH (US)

(73) Assignee: NCR Corporation, Dayton, OH (US)

( * ) Notice: Under 35 U.S.C. 154(b), the term of this patent shall be extended for 0 days.

(21) Appl. No.: 08/994,699

(22) Filed: Dec. 19, 1997

(51) Int. Cl.[7] ..... B65B 61/02
(52) U.S. Cl. ..... 53/411; 53/410; 53/449
(58) Field of Search ..... 53/411, 449, 410, 53/173, 131.2, 131.3, 131.4, 415; 206/534, 459.5, 232; 229/70; 383/127

(56) References Cited

U.S. PATENT DOCUMENTS

| | | | | |
|---|---|---|---|---|
| 2,264,295 | | 12/1941 | Carter . | |
| 3,278,015 | | 10/1966 | Bernstein . | |
| 3,933,304 | | 1/1976 | Judd . | |
| 4,185,405 | | 1/1980 | Giulie . | |
| 4,211,434 | | 7/1980 | Reese . | |
| 4,913,284 | | 4/1990 | Versaci . | |
| 4,923,112 | | 5/1990 | Dale et al. . | |
| 4,941,196 | | 7/1990 | Edelman et al. . | |
| 4,972,657 | | 11/1990 | McKee . | |
| 4,986,868 | | 1/1991 | Schmidt . | |
| 5,048,870 | * | 9/1991 | Mangini et al. | 206/232 |
| 5,064,664 | | 11/1991 | Hustad . | |
| 5,328,208 | | 7/1994 | Garrison . | |
| 5,390,796 | * | 2/1995 | Kerfoot, Jr. | 206/534 |
| 5,492,675 | | 2/1996 | Brizard . | |
| 5,603,409 | * | 2/1997 | Braverman | 206/534 |
| 5,626,286 | * | 5/1997 | Petkovsek | 229/300 |
| 5,631,068 | | 5/1997 | Smith . | |
| 5,642,906 | * | 7/1997 | Foote et al. | 283/67 |
| 5,921,065 | * | 7/1999 | Slyster et al. | 53/473 |

* cited by examiner

*Primary Examiner*—Linda Johnson
*Assistant Examiner*—Louis K. Huynh
(74) *Attorney, Agent, or Firm*—Charlene Stukenborg

(57) ABSTRACT

A combination custom printed form and container and method of using is provided. In a preferred embodiment, custom information for a prescription is printed on the form which includes information and warning labels to be attached to a prescription drug vial and information such as receipts and patient counseling information. After attaching the labels to the prescription drug vial, the prescription drug vial is placed in the associated container which is given to the customer.

10 Claims, 5 Drawing Sheets

COMBINATION CUSTOM PRINTED FORM AND CONTAINER AND METHOD OF USING

BACKGROUND OF THE INVENTION

The present invention relates to a combination custom printed form and container and method of using.

Current packaging systems require custom information to be printed on a form and then attached to an associated container, such as an envelope or bag. Such packaging systems are used for pick lists and pharmacy labels. For example, it is known to provide a pharmacy form including a label part and an information part (for example, patient counseling information) on one sheet in which the label part is applied to a drug container and the information part is pasted to a bag for the drug container. However, since the information part and the bag are separate, there exists the potential to attach the information to a bag or container other than the associated container. Also businesses must stock the forms and containers separately, adding to material handling and related costs.

It is known to provide an identification number pre-printed on a receipt portion and an associated container portion. However, custom information for the specific item or items which are to be included in the container is not capable of being pre-printed.

It is also known to provide individual envelopes for each dose of a medication to be given to individuals requiring special help with their dosages such as the elderly and small children being assisted by a care giver and to provide a bag for bulk distribution of medication. However, these systems do not assist a pharmacist in providing a vial of medicine and customized, printed information relating to the prescription.

There is a need for a combination form and container on which custom information can be printed about the item(s) to be dispensed in the container.

SUMMARY OF THE INVENTION

In accordance with the teachings of the present invention, a combination custom printed form and container and method of using is provided. In a preferred embodiment, custom information for a prescription is printed on the form which includes information and warning labels to be attached to a prescription drug vial and information such as receipts and patient counseling information to be distributed with the prescription drug vial. After attaching the labels to the prescription drug vial, the prescription drug vial is placed in the associated container which is given to the customer.

It is an important feature of the present invention that the custom printing occurs on the combination form and container, assuring that the correct documentation stays with the associated product, such as a prescription drug vial.

BRIEF DESCRIPTION OF THE DRAWINGS

Additional benefits and advantages of the present invention will become apparent to those skilled in the art to which this invention relates from the subsequent description of the preferred embodiments and the appended claims, taken in conjunction with the accompanying drawings, in which:

DETAILED DESCRIPTION

Figure 1A:
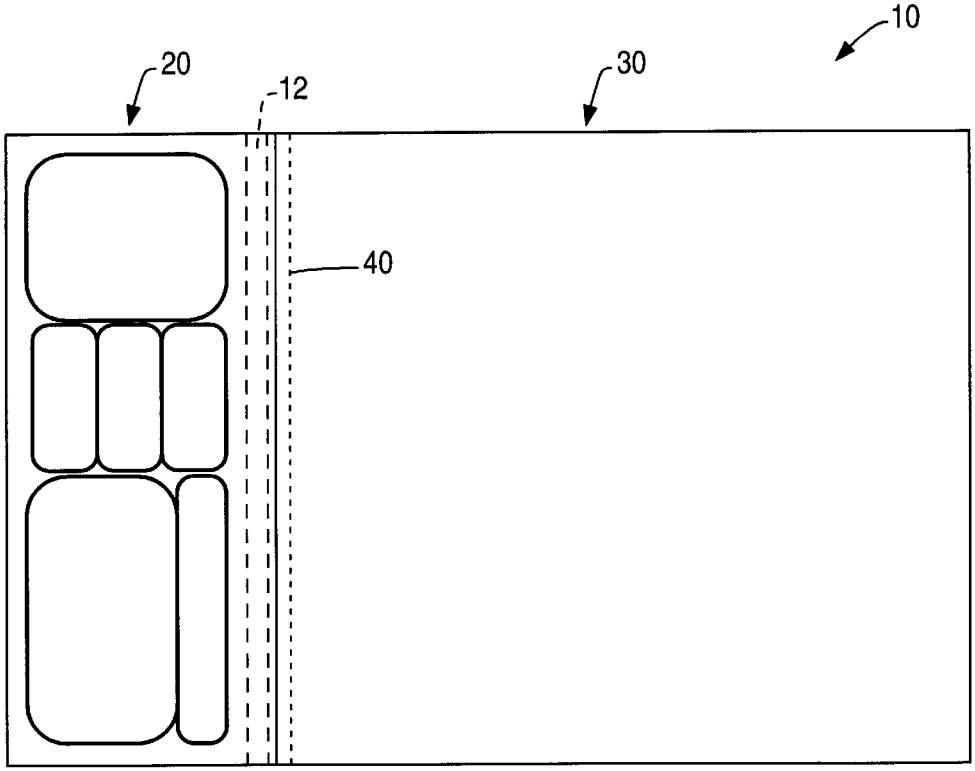
FIGS. 1A and 1B show a top view and a side view of a first embodiment of the combination form and container of the present invention.
Figure 1B:
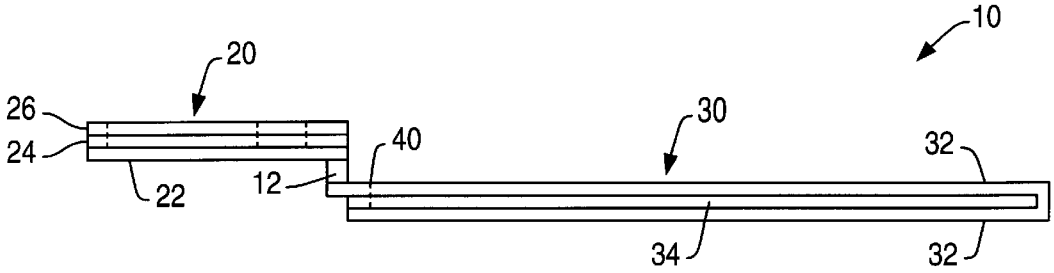

Referring now to the drawings, in which like-referenced characters indicate corresponding elements throughout the several views, attention is first drawn to FIG. 1A which shows a top view and FIG. 1B which shows a side view of a lap-joined construction combination form and container 10 according to a first embodiment of the present invention. A continuous glue or other adhesive line 12 joins a first ply 20 and a second ply 30 creating an overlap area. A perforation line 40 may be included to allow easy separation of the first ply 20 and the second ply 30.

The first ply 20 may be a paper ply or preferably a label ply. The first ply 20 preferably includes a release liner 22, a pressure sensitive adhesive 24 and label ply 26. Preferably, die-cuts, perforations or similar cuts are provided to form removable labels as is known in the art. These removable labels may be printed with custom information relating to the product to be placed in the associated container. For example, the removable labels may include a prescription drug vial label, warning labels, etc.

The second ply 30 may be single sheet of paper, cellophane, film, plastic, label ply with adhesive and a release liner, any combination of paper, cellophane or plastic or any other desirable ply for creating a container portion. At least a portion of the ply is printed with custom information relating to the product to be placed in the container. For example, the ply may include a receipt or patient counseling information. It may be desirable to have at least a portion of the ply which enables viewing of the product or contents in the container. The second ply 30 may be formed of a single ply 32 which is folded, and glued, collated, stitched, crimped, or adhered to itself on two sides such as by adhesive 34 to create an opening at one side for allowing the placement of a product therein. Alternatively, the second ply 30 may be formed of two pieces of material glued, collated, stitched, crimped or adhered together on three sides to provide an open side for allowing placement of a product therein. Any means of collating the two pieces of material to form a container large enough to hold an entire product such as a prescription drug vial is contemplated within the scope of the present invention. As another example, the two pieces of material may be attached using a tape around the perimeter. If the labels are provided on the container, the labels may include the pharmacy name and phone number and all prescriptions that a customer has at the pharmacy. Additionally, the labels may include renewal labels. The combination custom printed form and container is preferably 14 inches in length to provide a container with space for more than one individual vial.

Figure 2A:
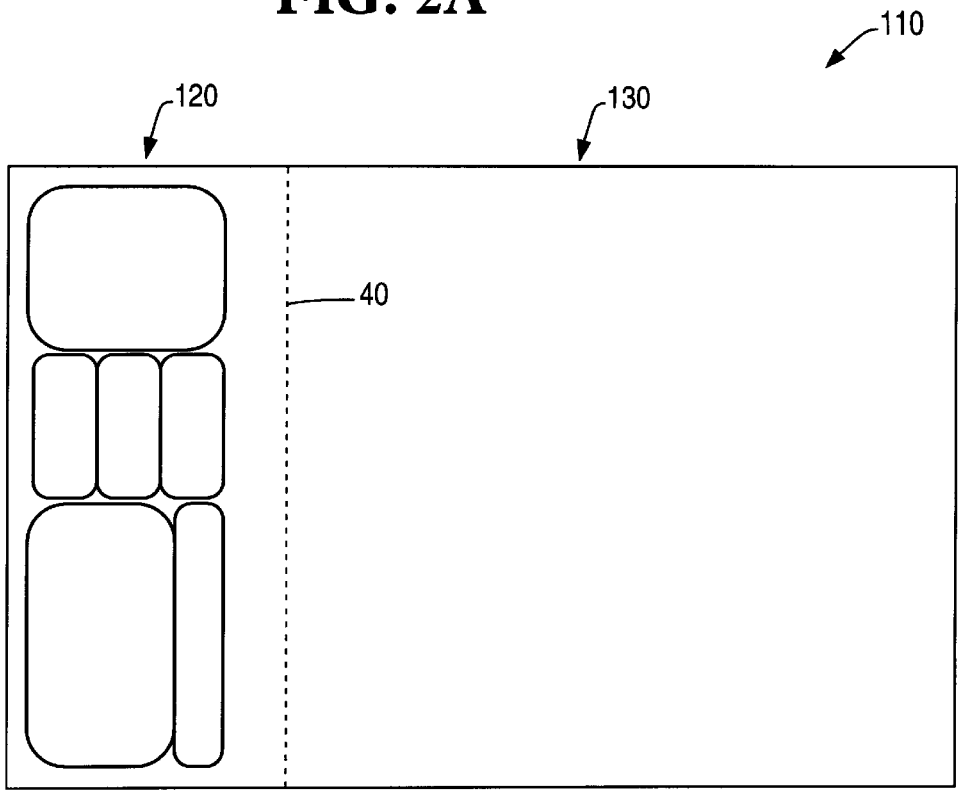
FIGS. 2A and 2B show a top view and a side view of a second embodiment of the combination form and container of the present invention.
Figure 2B:
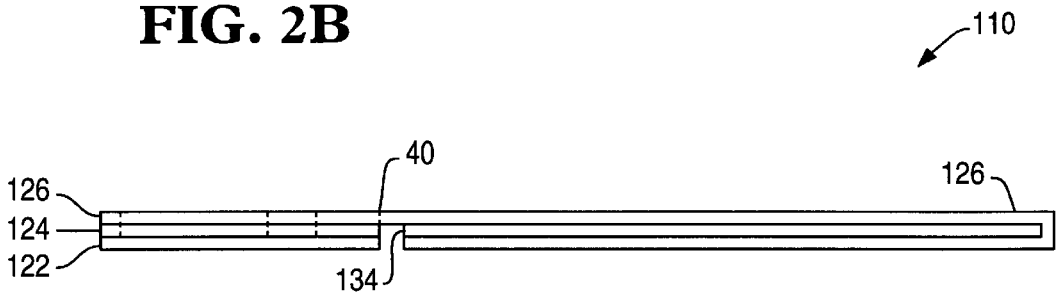

FIG. 2A shows a top view and FIG. 2B shows a side view of a single sheet integrated construction combination form and container 110 according to a second embodiment of the present invention.

The label portion 120 preferably includes a release liner 122, a pressure sensitive adhesive 124 and label ply 126. Preferably, die-cuts, perforations or similar cuts are provided to form removable labels as is known in the art. These removable labels may be printed with custom information relating to the product to be placed in the associated container. For example, the removable labels may include a prescription drug vial label, warning labels, etc.

The container portion 130 is also formed from paper ply or label ply with adhesive and a release liner 126. The container portion 130 may include an insert of cellophane, film, plastic, or any other see-through ply for creating a viewing window to view the contents of the container portion without opening the container. At least a portion of the ply is printed with custom information relating to the product to be placed in the container. For example, the ply may include a receipt or patient counseling information. It may be desirable to have at least a portion of the ply which enables viewing of the product or contents in the container, such as a clear acetate window or like material.

The container portion 130 is preferably formed of the single ply 126 which is folded, and glued, collated, stitched, crimped, or adhered to itself on two sides such as by adhesive 134 to create an opening at one side for allowing the placement of a product therein. Alternatively, the container portion 130 may be formed of two pieces of material glued, collated, stitched, crimped, or adhered together on three sides to provide an open side for allowing placement of a product therein. Any means of collating the two pieces of material to form a container is contemplated within the scope of the present invention. As another example, the two pieces of material may be attached using a tape around the perimeter. The combination custom printed form and container is preferably 14 inches in length to provide a container with space for more than one individual vial.

A perforation line 140 may be included to allow easy separation of the label portion 120 and the container portion 130.

Figure 3:
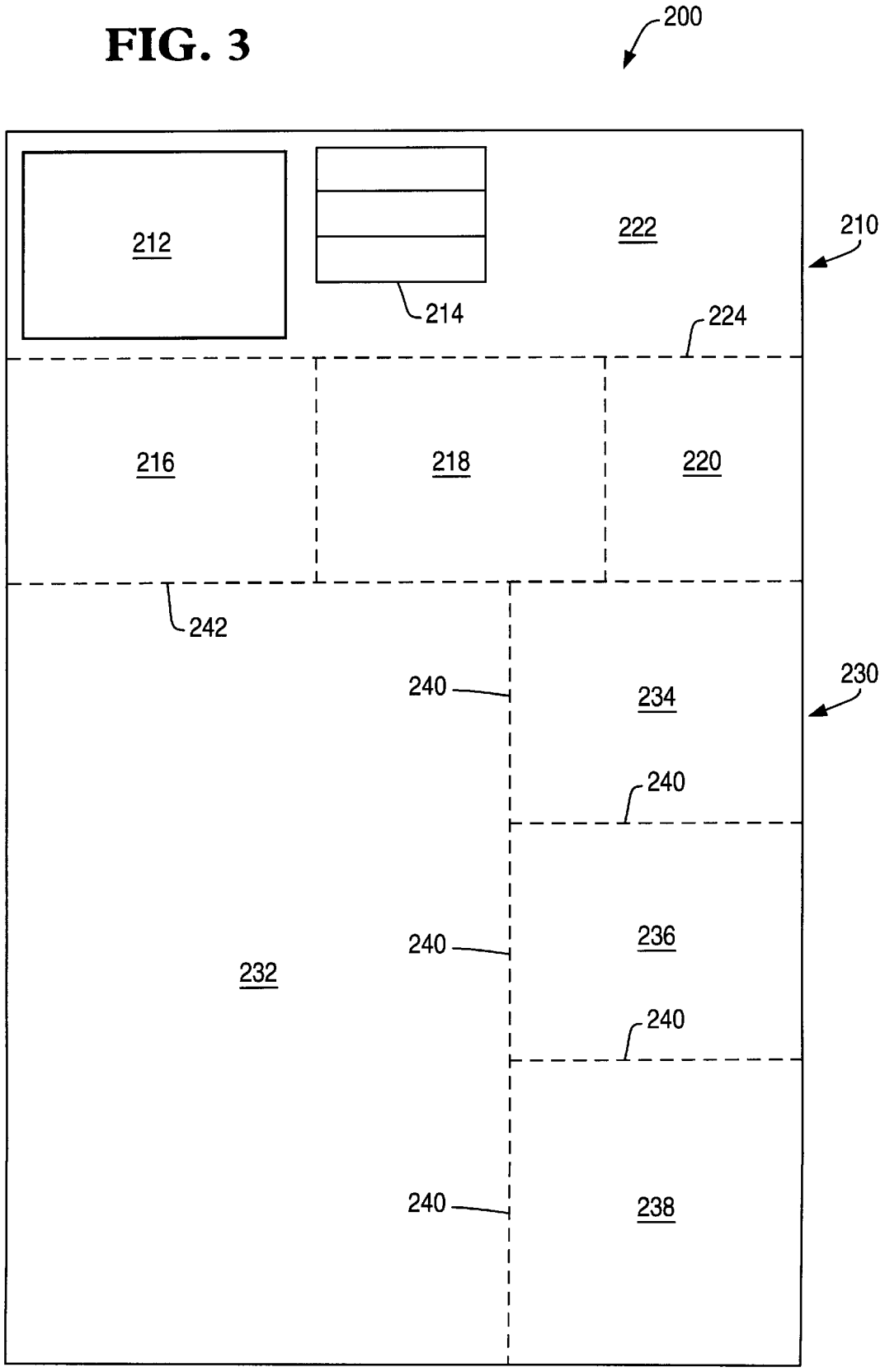
FIGS. 3 and 4 show exemplary block views of the combination form and container of the present invention.

FIG. 3 shows a detailed block front view of a combination form and bag 200 of either the first or second embodiment of the present invention. In this detailed view, the form portion 210 includes a vial label 212, warning labels 214, receipt 216, duplicate receipt 218, custom message such as coupon 220 and pharmacist's notes area 222. Perforation line 224 may be used to separate the label area of the form portion 210 from the receipt/coupon area. Container portion 230 may include a patient counseling area 232 and alternative coupon areas 234, 236 and 238. The areas of the container portion 230 may be easily separated by perforations 240. The container portion 230 may include a resealing glue, spot glue, remoistenable glue or transfer tape applied to the receipt and information areas 216, 218, 220 or a top flap area (not shown) for securing the opening.

Figure 4:
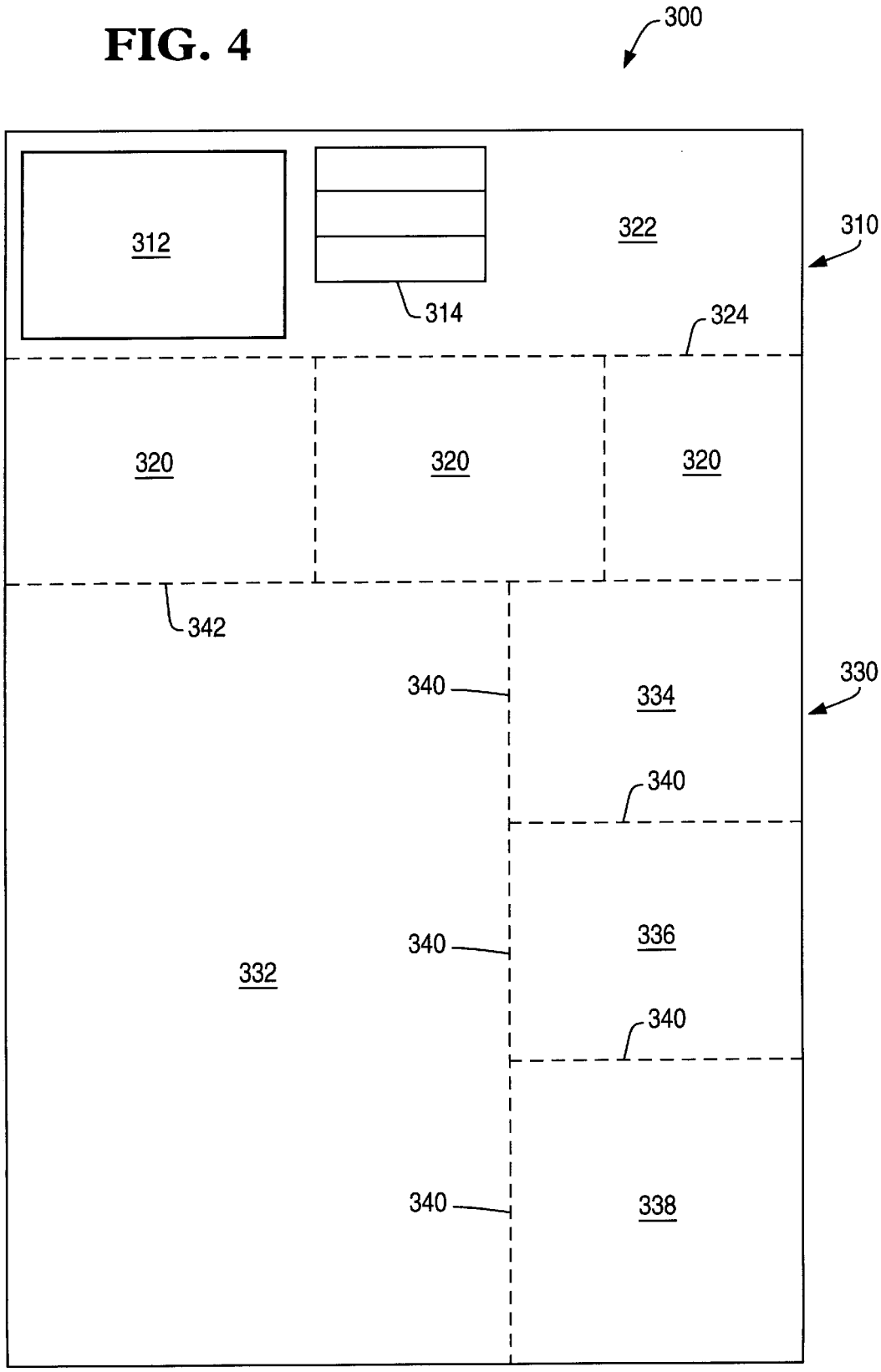

FIG. 4 shows another detailed block front view of a combination form and bag 300 of either the first or second embodiment of the present invention. In this detailed block view, the form portion 310 includes a vial label 312, warning labels 314, and pharmacist's note area 322. Perforation line 324 may be used to separate the label area of the form portion 310 from the coupon area 320. In this detailed block view, receipt area is included in container portion 330 and is indicated as receipt 334, duplicate receipt 336 and additional messaging area 338. Container portion 330 may also include a patient counseling area 232. The areas of the container portion 230 may be easily separated by perforations 340. The container portion 330 may include a resealing glue, spot glue, remoistenable glue, or transfer tape applied to the coupon area 320 or a top flap area (not shown) for securing the opening.

The combination form and container are preferably preprinted with standard information using either flexographic or lithographic printing techniques during manufacture of the combination form and container, preferably using a single pass through a flexographic press. The custom information can be printed using a variety of personal printers such as dot matrix, laser, ink jet, etc. or any other custom printing apparatus such as would be available to a pharmacist. The custom information can be printed using customized software and can include customer specific data, coupons, receipts, prescription identification information, prescription specific warnings, patient counseling information, prescription prices, bar codes, marketing messages, and the like for improved personalization/target marketing. The custom information may be obtained from any source such as mainframes, data warehouses, personal computer files, manual input, etc.

Figure 5:
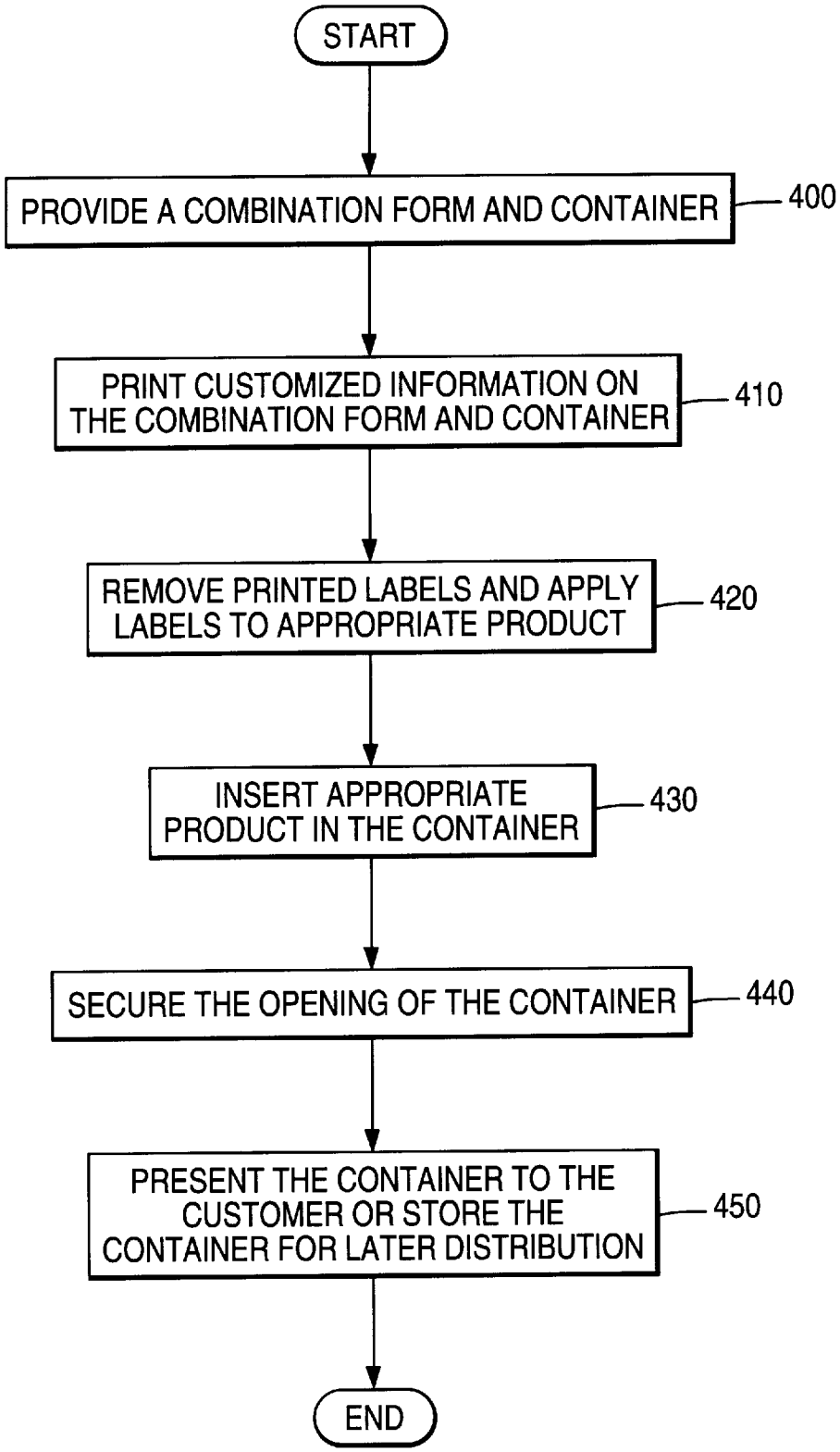
FIG. 5 shows a flowchart of the method of using the combination form and container of the present invention.

Referring to the flowchart of FIG. 5, the method of the present invention is presented. First in step 400, a combination form and container is provided. In step 410, the customized information is printed on the combination form and container. Next, the labels are removed from the form area and applied to an appropriate product in step 420. Next the product is inserted into the associated container in step 430. In step 440, the opening of the container is secured such as by folding the receipt portion over and stapling, gluing, taping, or adhering the materials together. Finally, in step 450, the product in the container is presented to the customer or stored for later distribution.

An advantage of the present invention is that it aids in the speed of the filling and processing prescriptions in the retail pharmacy environment by combining a label portion of a pharmacy script with a container portion. (A pharmacy script is a cut sheet laser document which can incorporate elements of a vial label, warning labels, receipt, duplicate receipt and monograph or patient counseling information).

Advantageously, the container portion can be variably imaged using software to customize the container with the customer's name, list of all prescriptions ordered, list price of each prescription, list total order amount, uniform product code (UPC) bar code, print receipts, print coupons or other marketing messages desired by the retailer. This combination form and container also aids in loss prevention through reduced shrinkage by listing all items on one receipt boldly imprinted with an amount or UPC bar code to improve check-out procedures at the check-out terminal.

Advantageously, the combination form and container of the present invention provides improved prescription fill efficiency, reduced prescription mismatches, reduced number of different parts to inventory, improved check-out procedures, and enhanced target marketing capabilities.

Although the above description has included two embodiments, it is contemplated that other constructions for providing a combination form and container are within the scope of the present invention. For example, the container of the present invention may include expansion joints such as accordion-type panels to allow larger or more vials to be placed in the container. As another example, the combination form and container may also include additional plies included on the top of the form and container as described above. These additional plies may contain duplicate information for recordkeeping or other purposes. As another example, the combination form and container may be constructed so that the form is actually a part of the container, with the release liner under the labels providing structure after the labels are removed and applied to the product.

Although the above described forms only provide vial label and warning labels for one medicine, additional labels can be provided on a form to allow for dispensing of multiple medications to a patient using one combination form and container. Alternatively, a two tray printing system can be used in which one tray includes the combination custom printed form and container of the present invention for printing information relating to the first prescription and the second tray includes standard forms with vial and related labels and product information for printing information relating to the other prescriptions.

Although the invention has been described with particular reference to certain preferred embodiments thereof, variations and modifications of the present invention can be effected within the spirit and scope of the following claims.

What is claimed is:

1. A method comprising the steps of:

providing a combination form and container having an opening and removable labels;

printing customized information on the combination form and container, wherein customized information is printed on the removable labels and the combination form and container in a single operation;

removing labels from the combination form and container;

applying the removable labels to an appropriate product;

inserting the product into the combination form and container; and securing the opening of the combination form and container with the product inside.

2. The method of claim 1 further including the step of presenting the labeled product in the combination form and container to a customer.

3. The method of claim 1 wherein the step of printing customized information on the combination form and container further includes printing at least one vial label, at least one warning label, at least one customer receipt and at least one section of patient counseling information.

4. A method for use by a pharmacist in providing a labeled prescription drug vial and related information to a customer, comprising the steps of:

providing a combination form and container including removable labels;

printing customized prescription drug information on the combination form and container, wherein customized prescription drug information is printed on the removable labels and the combination form and container in a single operation;

removing labels from the combination form and container;

applying the removable labels to the prescription drug vial;

inserting the prescription drug vial into the combination form and container; and securing the opening of the combination form and container with the labeled prescription drug vial inside.

5. The method of claim 4 further including the step of presenting the labeled prescription drug vial in the combination form and container to a customer.

6. The method of claim 4 wherein the step of printing customized information on the combination form and container further includes printing at least one vial label, at least one warning label, at least one customer receipt and at least one section of patient counseling information.

7. A method comprising the steps of:

providing a combination form and container having a opening, wherein said combination form and container includes at least one removable label;

printing customized information on the combination form and container, including on the at least one removable label;

removing the at least one removable label from the combination form and container;

applying the at least one removable label to an appropriate product;

inserting the labeled product into the combination form and container; and securing the opening of the combination form and container with the labeled product inside.

8. The method of claim 7 wherein the step of printing customized information on the combination form and container further includes printing at least one vial label, at least one warning label, at least one customer receipt and at least one section of patient counseling information.

9. A method for use by a pharmacist in providing a labeled prescription drug vial and related information to a customer, comprising the steps of:

providing a combination form and container having a opening, wherein said combination form and container includes at least one removable label;

printing customized prescription drug information on the combination form and container, including on the at least one removable label;

removing the at least one removable label from the combination form and container;

applying the at least one removable label to an appropriate prescription drug vial;

inserting the prescription drug vial into the combination form and container; and securing the opening of the container with the prescription drug vial inside.

10. The method of claim 9 wherein the step of printing customized information on the combination form and container further includes printing at least one vial label, at least one warning label, at least one customer receipt and at least one section of patient counseling information.

* * * * *

UNITED STATES PATENT AND TRADEMARK OFFICE

CERTIFICATE OF CORRECTION

PATENT NO. : 6,167,679 B1 
DATED : January 2, 2001
INVENTOR(S) : Katherine C. Horton-Steidle et al.

It is certified that error appears in the above-identified patent and that said Letters Patent is hereby corrected as shown below:

Column 5,
Line 46, delete “the” and insert -- an appropriate labeled --.

Column 6,
Line 10, delete “a”, second occurrence, and insert -- an --.
Line 33, delete “a”, second occurrence, and insert -- an --.

Signed and Sealed this

Tenth Day of September, 2002

*Attest:*

*Attesting Officer*

JAMES E. ROGAN
*Director of the United States Patent and Trademark Office*